US005175037A

United States Patent [19]

Merckens et al.

[11] Patent Number: 5,175,037

[45] Date of Patent: Dec. 29, 1992

[54] BELT FOR PAPERMAKING MACHINES

[75] Inventors: Otto G. I. Merckens; Eberhard Janssen; Walter Schaaf, all of Duren, Fed. Rep. of Germany

[73] Assignee: Thomas Josef Heimbach GmbH & Co., Duren, Fed. Rep. of Germany

[21] Appl. No.: 517,308

[22] Filed: May 1, 1990

[30] Foreign Application Priority Data

May 2, 1989 [DE] Fed. Rep. of Germany ..... 3914533

[51] Int. Cl.[5] ..... B32B 3/00

[52] U.S. Cl. ..... 428/57; 428/222; 428/223; 428/224; 162/901; 139/383 A; 139/383 AA

[58] Field of Search ..... 428/222, 223, 224, 57; 162/358, DIG. 1; 139/383 A, 383 AA; 100/118, 151

[56] References Cited

U.S. PATENT DOCUMENTS

| | | | |
|---|---|---|---|
| 1,536,533 | 5/1925 | Sheehan | 162/358 |
| 3,617,425 | 11/1971 | White | 428/222 |
| 4,238,287 | 12/1980 | Gill | 162/358 |
| 4,311,172 | 1/1982 | Eckstein | 162/DIG. 1 |
| 4,552,620 | 11/1985 | Adams | 162/358 |
| 4,559,258 | 12/1985 | Kiuchi | 428/156 |
| 4,564,551 | 1/1986 | Best | 428/222 |
| 4,601,785 | 7/1986 | Lilja | 162/DIG. 1 |
| 4,743,482 | 5/1988 | Johansson | 428/57 |
| 4,842,925 | 6/1989 | DuFour | 428/223 |
| 4,880,501 | 11/1989 | Schiel | 162/358 |
| 4,948,658 | 8/1990 | Halker | 428/234 |

FOREIGN PATENT DOCUMENTS

| | | |
|---|---|---|
| 0052350 | 5/1982 | European Pat. Off. . |
| 0098502 | 6/1983 | European Pat. Off. . |
| 0138797 | 4/1985 | European Pat. Off. . |
| 0185108 | 6/1986 | European Pat. Off. . |
| 3231039 | 3/1983 | Fed. Rep. of Germany . |
| 3235468 | 5/1983 | Fed. Rep. of Germany . |
| 8319684 | 10/1984 | Fed. Rep. of Germany . |
| 3318984 | 11/1984 | Fed. Rep. of Germany . |

*Primary Examiner*—Ellis P. Robinson
*Assistant Examiner*—Nasser Ahmad
*Attorney, Agent, or Firm*—Joseph W. Berenato, III

[57] ABSTRACT

The present invention provides a belt for papermaking machines, said belt comprising a flexible belt layer impermeable to liquids and is smooth on its backside while its front side integrates, but only partly, a support-track having cavities and it contains longitudinal threads extending in the direction of advance and located between the support track and the backside of the belt.

50 Claims, 4 Drawing Sheets 1
2
3
4
5
6
8
10
11
12
17
18
19
20
21
22

BELT FOR PAPERMAKING MACHINES

The invention concerns a belt for papermaking machines, in particular when wet-pressing with an extended compression slit, said belt comprising a flexible belt- layer impermeable to liquids and smooth on its back side while its front side integrates but only partly a support-track having cavities, for instance a fabric, knit or a belt of wire-links, longitudinal threads extending in the belt layer in the direction of advance of the belt.

BACKGROUND OF THE INVENTION

In the wet-pressing mode of papermaking machines, a substantial part of the residual liquid still in the paper web is pressed out between compression rollers forming a compression slit. The paper web is made to pass through the compression slit by means of a revolving wet felt, the liquid being pressed out of the paper web in the compression slit into the wet felt and then being drained.

Recently wet presses with extended compression slits, the so-called "shoe presses" have been developed, where the paper web is exposed over a longer path and hence over a correspondingly longer time to high compressions so that it shall exit the wet press with less moisture. Belts are employed to guide the paper web and at least one wet felt through such an extended slit, said belts comprising a flexible belt layer impermeable to liquids and smooth on its back side. By means of this smooth back side said belts pass over a hydraulically loaded pressure pad in the compression slit which will press the belt toward an opposite compression roller. The paper web to be dehydrated is made to pass between this compression roller and the belt and is accompanied at least on one side by a co-moving wet felt draining the pressed-out water.

Such belts are subjected to high stresses in the longitudinal and transverse directions when in the compression slit and they also undergo more than trivial abrasion on both sides. To solve the former problem, it has been suggested to fully integrate a fabric acting as a support track into the belt layer (German Offenlegungsschriften 32 31 039 and 33 18 984; U.S. Pat. No. 4,559,258). However these designs have failed the test of practice.

In order to improve the water drainage from the front side of the belts, that is from the side facing the paper web and resting against a co-moving wet felt, the front side is textured. Belts have been developed for that purpose in which support tracks were integrated only in part on the front side, so that they partly project above the belt layer. As a result cavities and ducts were created for water drainage. Multi-ply fabrics have been suggested as support tracks (German patent 32 35 468; European patent 0 098 502; European Offenlegungsschrift 0 138 797; German Gebrauchsmuster 83 19 684.6; European Offenlegungsschrift 0 185 108). In lieu of fabrics, belts of wire-links also have been proposed (European patent 0 098 502) or knits (European Offenlegungsschrift 0 290 653). As regards the embodiment of the support track as a wire-link belt, it was suggested additionally to make the mutually coupled wire spirals longitudinal and to additionally insert into them multifilaments and/or monofilaments to absorb the longitudinal forces (European patent 0 098 502). The purpose of their introduction into the belt layer is to improve belt dimensional stability and also the adhesion of the wire spirals to the belt layer.

Where the belts support tracks were fabrics partly integrated into the belt layer, it has been additionally suggested to design the outwardly projecting part of the fabric as the wear layer and the part of the fabric integrated into the belt layer as the traction-absorbing base-layer (German Gebrauchsmuster 83 19 684.6). It is moreover in the state of the art of such belts to select part of the longitudinal threads to be made of a material exceedingly dimensionally stable longitudinally and to make the other part of the longitudinal and also transverse threads from a highly wear-resistant material (European patent 0 185 108). The purpose is to achieve better wear resistance, pressure distribution, longitudinal dimensional stability and rolling resistance.

Just as it was found that complete integration of a fabric (German Offenlegungsschrift 3 231 039) into the belt layer was unsatisfactory in practice, so it was found it is inappropriate to make the only partly integrated support track enter too deeply the belt layer and, in the extreme case, to have it stretch over the entire cross-section of the belt layer (German patent 32 35 468). Because of the high compression and compression stresses with different forces exerted at the belt's front and back sides, especially in the compression slit, the bond between the support track and the belt layer is not permanently secured. Furthermore, the belt layer requires an extraordinary thickness so that in spite of its deep integration into the cross-section of the belt layer it shall still project from it in order that a cavity volume required for water drainage be formed. However so thick a support track entails the belt becoming stiff and therefore shall only poorly adapt to the shape of the of the pressure pad. Again, the manufacture of such a support track is complex and hence costly.

In view of the above, the support track preferably is integrated only slightly, that is no more than into half the thickness of the belt layer (European patent 0 098 502). This entails however a tradeoff in that the support more easily is torn out of the belt layer. Even the additional longitudinal threads cannot prevent this consequence because being integrated only into the edge zone of the belt layer. Nor do these longitudinal threads prevent the formation of a compression bead in front of the pressure pad as seen in the direction of advance, and moreover they absorb longitudinal forces only in a limited way because anyway being in a zone which is tension-relieved by the support track. Accordingly a comparatively hard material is required for the belt layer so that the above compression bead shall not occur. As a consequence, the belt is comparatively stiff and only incompletely adapts to the shape of the pressure pad.

The object of the invention is to create a belt of the above kind which on one hand can withstand high traction and compression stresses but on the other hand evinces high flexibility and therefore adaptability to particulars, especially in the compression slit.

SUMMARY OF THE INVENTION

This problem is solved by the following features of the belt of the invention:

(a) The longitudinal threads essentially extend between the support track and the belt's back side, (b) The longitudinal threads are linked at their ends in traction-resistant manner.

The invention retains the characteristic of the support track being only integrated into a partial cross-section of the belt layer in order that thereby a support track of comparatively simple design shall assure adequate dehydration at the front side of the belt layer and so that the belt shall not be unduly stiffened by the support track. This design is combined with the arrangement of additional longitudinal threads that—unlike the state of the art—do not pass through the support track but instead extend outside the support track into the zone not occupied by it. Because the longitudinal threads also are mutually linked in traction-resistant manner—whether directly or by the insertion of means of high tensile strength—they can absorb high tensile forces. In this manner the belt layer is reinforced and dimensionally stabilized where heretofore in belts of this species it had been most jeopardized. Thereby the belt layer is endowed with uniform expansion characteristics over its cross-section that are determined on one hand by the support track and on the other hand by the longitudinal threads. This prevents extensively any compression beads and moreover makes it possible now to use a comparably soft material for the belt layer. The belt thereby has become adaptive, the more so that the longitudinal threads do not practically affect the belt flexibility because not elongating in the direction of thickness.

Regarding the design of the support track, the additional integration of the longitudinal threads results in substantially greater freedom. No longer is there any restriction on using belts of wire links with wire coils extending in the direction of advance (European patent 0 098 502), which is a combination anyhow hardly applicable to practice. Both as regards the material selection for the support track and the structure, restrictions no longer apply. Illustratively the longitudinal threads may be made of a material with a higher tensile strength than found in the tensively loaded parts of the support track. Materials for the support track need no longer be optimized regarding their tensile strengths, but instead they may better match the support track requirements. For instance at least the parts of the support track forming the outer plane may be made of a material which is more wear-resistant than the longitudinal threads. The support track also may be made of a highly wear-resistant material.

In lieu of the design of individual longitudinal threads adjacent to one another in the transverse direction and with traction-proof linkage at their ends, the problem basic to the invention can be solved by the following features:

(a) The longitudinal threads essentially extend between the support track and the belt's back side, (b) The longitudinal threads are formed by at least one individual thread wound in coiled form in the direction of advance and progressing transversely to it.

In this case the longitudinal threads are formed by one or more continuous single threads which on account of their slope relative to the transverse direction do not precisely extend in the direction of advance. Nevertheless they offer the same advantages as the embodiment mode with single threads stretching in the direction of advance.

As a rule it should be enough that the longitudinal threads extend in a plane parallel to the belt's back side. However it is also possible to make the longitudinal threads pass in several planes parallel to the belt's back side.

The advantages of the longitudinal threads arrayed in the manner of the invention remain unaffected by their being linked with and/or bound into the support tracks at regular intervals. On the contrary an additional advantage results, namely that the support track is better anchored in the belt layer, ie, it shall not tend to tear out of the belt layer. Thereby the longitudinal threads fill an additional function.

A further feature of the invention provides that at least one addition thread be integrated into the belt layer and extend in zig-zag manner progressively over the belt's direction of advance. This addition thread while progressing over the entire belt width in the direction of advance on the other hand does not do so rectilinearly, but in zig-zag form, whereby its individual thread segments between the reversal points essentially extend transversely to the belt's direction of advance. Thereby the belt is endowed in its transverse direction with higher strength, in particular against tension and compression stresses in this direction. Such stresses take place in particular at the lateral boundaries of the pressure pad and may lead to belt bulging at both edge zones.

Especially advantageously the addition thread, or several such, shall be guided in such manner that those thread segments which are outside the support track alternate with thread segments bound into the support track. In this manner high support-track resistance against tear-out is additionally provided without this track requiring being deeply integrated into the belt layer.

Provision is further made that the, or at least one of the addition threads shall assume a coiled course with reversal of direction between two thread segments. This means that one thread segment passes outside the support track and following one reversal of direction shall pass through the support track and upon another reversal of direction again shall be located outside the support track. Appropriately the addition thread or at least one of them shall pass between the edges of the belt. Care must however be taken that the particular addition thread does not project beyond the support track edge, and that the reversal of direction shall take place within the lateral boundaries of the support track.

It is known from the state of the art that fabrics, in particular multiple ply fabrics, knits and in particular wire-link belts are applicable as support tracks.

In the latter case those wire-link belts are preferred that consist of wire spirals extending transversely to the belt's direction of advance because when the belt is Where such a wire-link belt is use d, appropriately the addition thread(s) shall pass each time by one thread segment through one wire spiral and by means of the next thread segment, and following reversal of direction, above the next wire spiral.

As regards the tear-out strength of the support track, advantageously the longitudinal threads shall pass between the support track and the thread segments of the, or at least one of the addition threads outside the support track. In this manner the longitudinal threads contribute to improving the tear-out strength of the support track. The longitudinal threads may be connected to the, or at least one of the addition threads at crossing points.

As long as the longitudinal threads of claim 1 consist of single threads, then these may be tied together at their ends by knots, fusing, twisting or the like in order to provide traction-proof linkage.

The belt may be made seamless if so permitted by the installation features of the papermaking machine to receive the belt. In most cases however installation shall be at least made easier if the belt is designed in such a way as to have a cross-seam where the belt layer is interrupted and the support track can be split up. Such separability of the support track can be implemented with fabrics and knits for instance by providing a plug-in wire seam such as are known in dry screens for papermaking machines. Wire-link belts with wire spirals extending transversely to the direction of advance may be separated practically anywhere provided that the wire spirals be coupled together by coupling wires. By removing the plug-in or coupling wire it is then feasible to split up the support track whereby the belt can be conveniently pulled into the papermaking machine. Following the closure of the belt by inserting the plug-in wire coupling wire, the gap in the belt layer is sealed using an adhesive, so that the belt layer is impermeable to liquids also in the vicinity of the cross-seam.

There are two ways to link the longitudinal threads of such a belt with cross-seam. On one hand the ends of the longitudinal threads may be connected in detachable manner in the vicinity of the cross-seam, for instance by their forming overlapping loops through which passes a plug-in wire. Accordingly a plug-in wire seam connection may also be provided for the longitudinal threads. Another possibility is to affix the ends of the longitudinal threads in the vicinity of the cross-seam to plug-in wires passing transversely through the support track and spaced from one another.

If this is implemented on both sides of the cross-seam, the longitudinal threads need not be loosened (though this is feasible) to open the cross-seam.

Departing from the above solutions, the ends of the longitudinal threads on both sides of the cross-seam also may be connected in undetachable manner to the support track. In that case however the traction is transmitted in the vicinity of the seam by the support track itself, whereby it must be of adequate tensile strength at least in this zone. On the other hand this design offers the advantage that the longitudinal threads need not be considered when opening or closing the cross-seam, that is, no separate procedure for establishing the traction-proof connection of the ends of the longitudinal threads is incurred. Illustratively this can be implemented in that the longitudinal threads are wound around the plug-in wires and then extend into the belt layer as far as latter's interruption.

Where the longitudinal threads are affixed in the vicinity of the cross-seam to the support track itself, whether detachably or not, those parts of the support track subject to longitudinal traction in the zone between the fastenings of the longitudinal threads to the support track should be made of the same material as the longitudinal threads themselves.

The belt of the invention can be manufactured in such manner that following the making of the support track, several longitudinal threads are peripherally deposited on that side which shall be equipped with the belt layer, or that at least a single thread shall be spirally wound before deposition of the belt layer. After deposition of the belt layer, the longitudinal threads extend within it and outside the support track.

Where a support track with a separable seam is being used, manufacture should be such that the longitudinal threads in the vicinity of the seam are made to pass from the zone provided for the belt layer to the side of the support track , further that with closed seam the belt layer shall be deposited on the support track and that after solidification of the belt layer the seam of the support track shall be opened and the belt layer shall be severed in the direction of the cross-seam. Appropriately the support track shall be protected in the vicinity of the cross-seam against penetration from the belt-layer material, for instance by means of a corresponding protective layer to cover the support track or by filling the support track with a soluble, and especially a water-soluble substance such as polyvinyl alcohol.

Lastly the method provides that the longitudinal threads on both sides of the cross-seam vicinity be linked to the support track before the belt layer is deposited.

BRIEF DESCRIPTION OF DRAWINGS

The invention is elucidated inthe drawing in relation to illustrative embodiments.

DESCRIPTION OF THE PREFERRED EMBODIMENT

Figure 1:
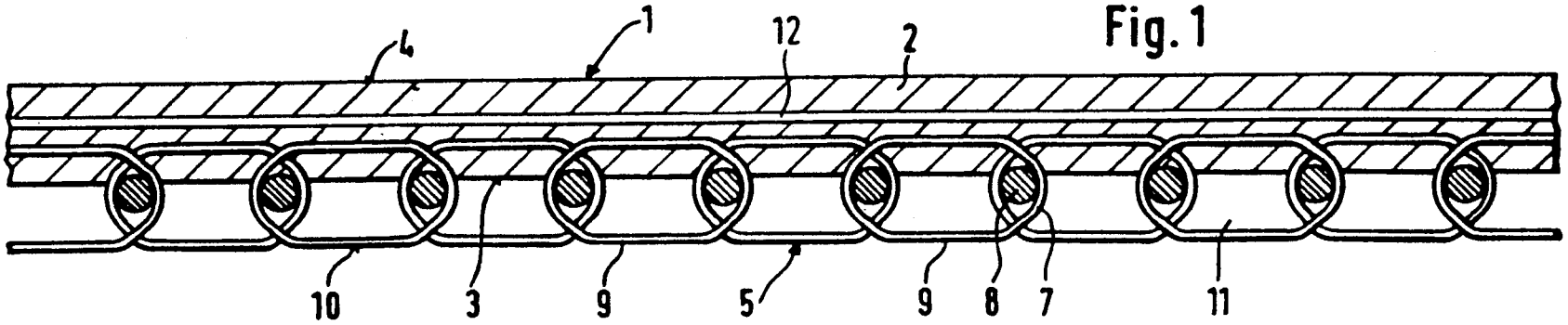
FIG. 1 is a longitudinal section of a belt of the invention.

The belt 1 shown in FIG. 1 comprises a belt-layer 2 with a front side 3 and a back side 4. The back side 4 is ground smooth. When duly used in the wet press of a papermaking machine with extended compression slit, this back side 4 slides past the press pad present in that compression slit.

A wire-link belt 5 serving as a support track is partly integrated into the front side 3 of the belt layer 2. Such wire-link belts 5 are used especially as drying belts in the drying part of papermaking machines. They consist of a plurality of wire spirals illustratively denoted by 6 extending transversely to the direction of advance of the belt 1 and being adjacent, as seen in this direction of advance, and overlapping by their head arcs illustratively denoted by 7. Said spirals are linked in articulating manner to one another in the overlap zone of the head arcs 7 by means of coupling wires illustratively denoted by 8 extending across the entire widths of the wire spirals 6. The legs, illustratively denoted by 9, of the turns of these wire spirals and extending between two head arcs 7 are essentially rectilinear so that a substantially plane support surface 10 is subtended at the free side of the wire-link belt 5. In due application of the belt 1 in the papermaking machine, a wet felt cloth will rest against this support surface 10. The paper web to be dehydrated is borne on the other side of the wet felt cloth.

FIG. 1 shows that the wire-link belt 5 has been integrated only by one third into the belt-layer 2, that is, only as far as the coupling wires 8. Thereby large cavities 11 are created inside the external parts of the wire spirals 6 and will absorb water when the paper web is being pressed and shall rapidly drain this water.

Longitudinal threads illustratively denoted by 12 extend in the direction of advance (arrow A) inside the belt layer 2, that is in the area between the wire-link belt 5 and the back side 4. There are a number of longitudinal threads 12 arrayed next to each other in one plane that is parallel to the plane of the back side 4. The longitudinal threads 12 enclose the entire belt 1 and essentially serve to absorb the traction in that area of the belt layer 2 which is not taken up by the wire-link belt 5. It is clear per se that the longitudinal threads 12 also can be arrayed in several superposed planes.

Figure 2:
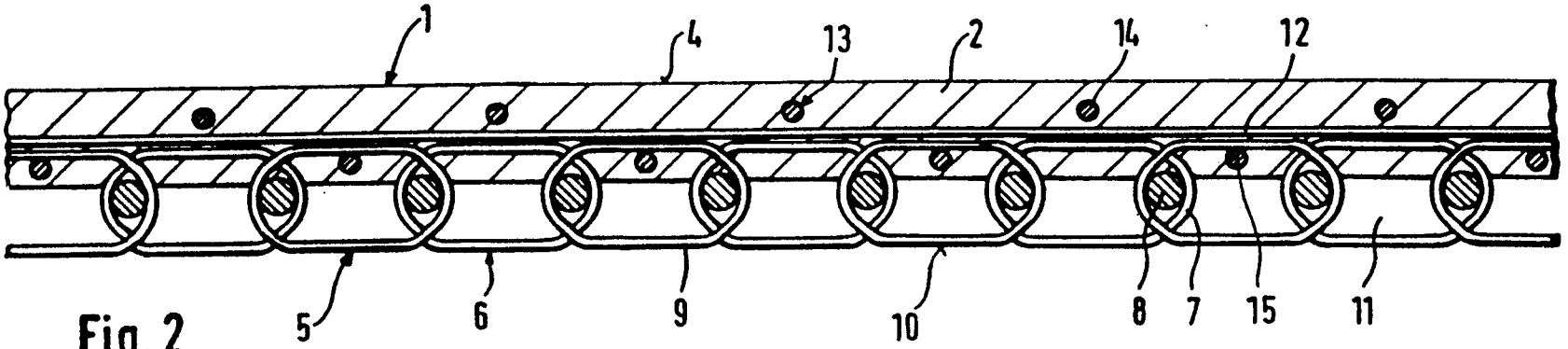
FIG. 2 is a longitudinal section of another belt of the invention.

The embodiment mode of a belt 1 shown in FIG. 2 coincides with that of FIG. 1 with one exception, so that the same components shall be denoted by the same reference numerals and to that extent also the previous description shall serve. The exception is that an addition thread 13 passes through the belt layer 2 in alternating manner, namely once by one thread segment—illustratively denoted by 14—outside a wire spiral 6, that is between the wire-link belt 5 and the back side 4, and once by one thread segment—illustratively denoted by 15—within an adjacent wire spiral 6.

Figure 3:
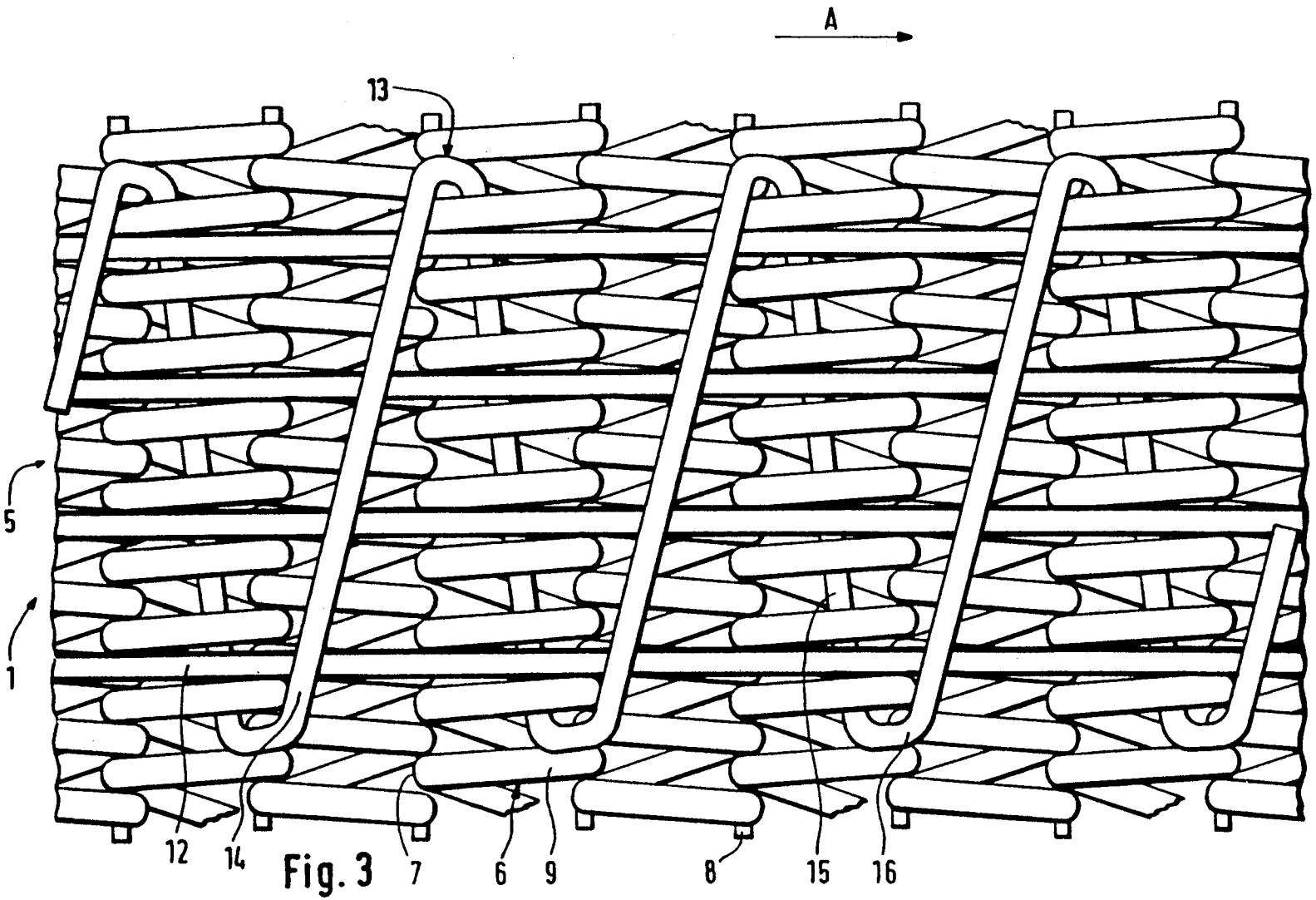
FIG. 3 is a topview of the support track with the belt-layer of the belt of FIG. 2.

The course of the longitudinal threads 12 and of the addition thread 13 is more clearly shown by FIG. 3 representing the wire-link belt 5 prior to the deposition of the belt layer 2, i.e. without it. The addition thread 13 moves to-and-fro between the edges of the wire-link belt 5 in zig-zag manner, in this special case even in coiled manner, namely once through a wire spiral 6 and following reversal of direction above the particular ad]acent wire spiral 6. The reversal points of the addition thread 13 are illustratively denoted by 16 and are selected in such a way that the addition thread 13 exits from, or enters the wire-link spiral 6 before its last turn.

FIGS. 2 and 3 moreover show that the longitudinal threads 12 pass between the wire-link belt 5 and the thread-segments 14 located outside the wire spirals 6. In this manner not only the addition threads 13, but also the longitudinal threads 12 serve to improve the adhesion of the wire-link belt 5 to the belt layer 2, that is, to prevent the wire-link belt 5 from being torn out of said layer. It is obvious too that several addition threads 13 as well can be connected in the shown manner to the wire-link belt 5, illustratively also in such manner that a second addition thread always passes inside the wire spirals 6 where the first addition thread 13 is outside the particular wire spiral 6, and vice-versa.

Figure 7:
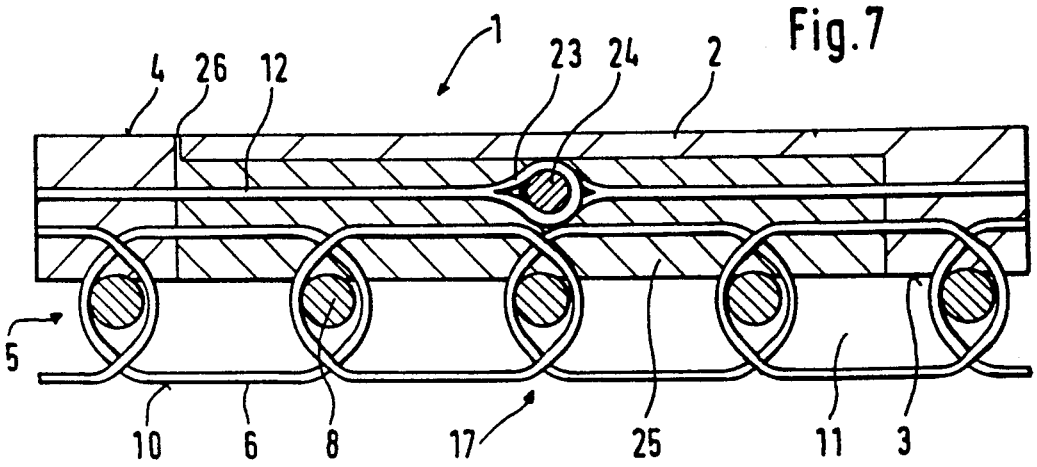
FIG. 7 is the cross-seam zone of the belt of FIGS. 1 and 4 after being inserted into the papermaking machine.
Figure 8:
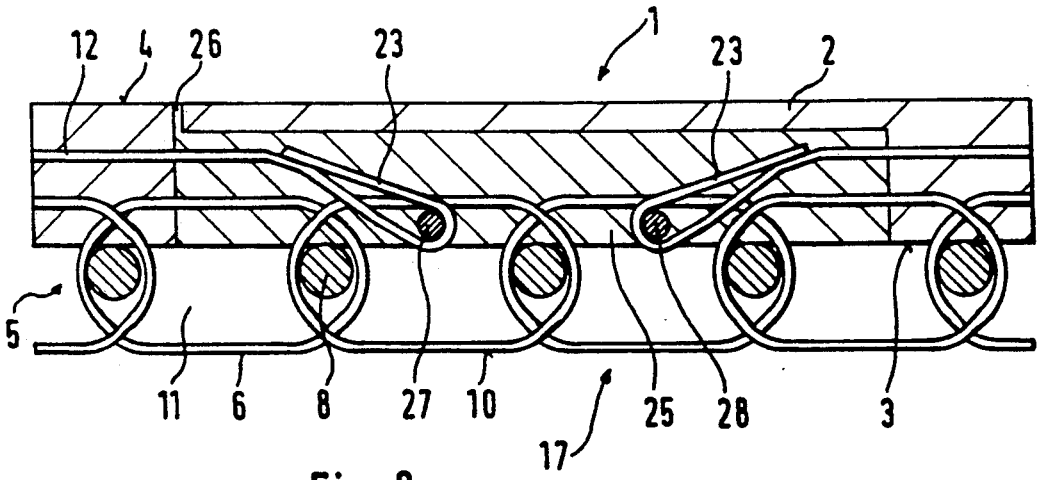
FIG. 8 is the cross-seam zone of another belt after being inserted into the papermaking machine.

FIGS. 4 through 8 show variously designed zones of the cross-seam. Again identical components and/or components filling the same functions shall be denoted by the reference numerals already employed for FIGS. 1 through 3 and the previous description shall also serve. The embodiment modes of FIGS. 3 through 6 show the state of the belt 1 each time before splitting up the belt layer 2, and the representation of FIGS. 7 and 8 show the state following insertion of the belt 1 into the wet press of a papermaking machine.

Figures 4, 5, 6:
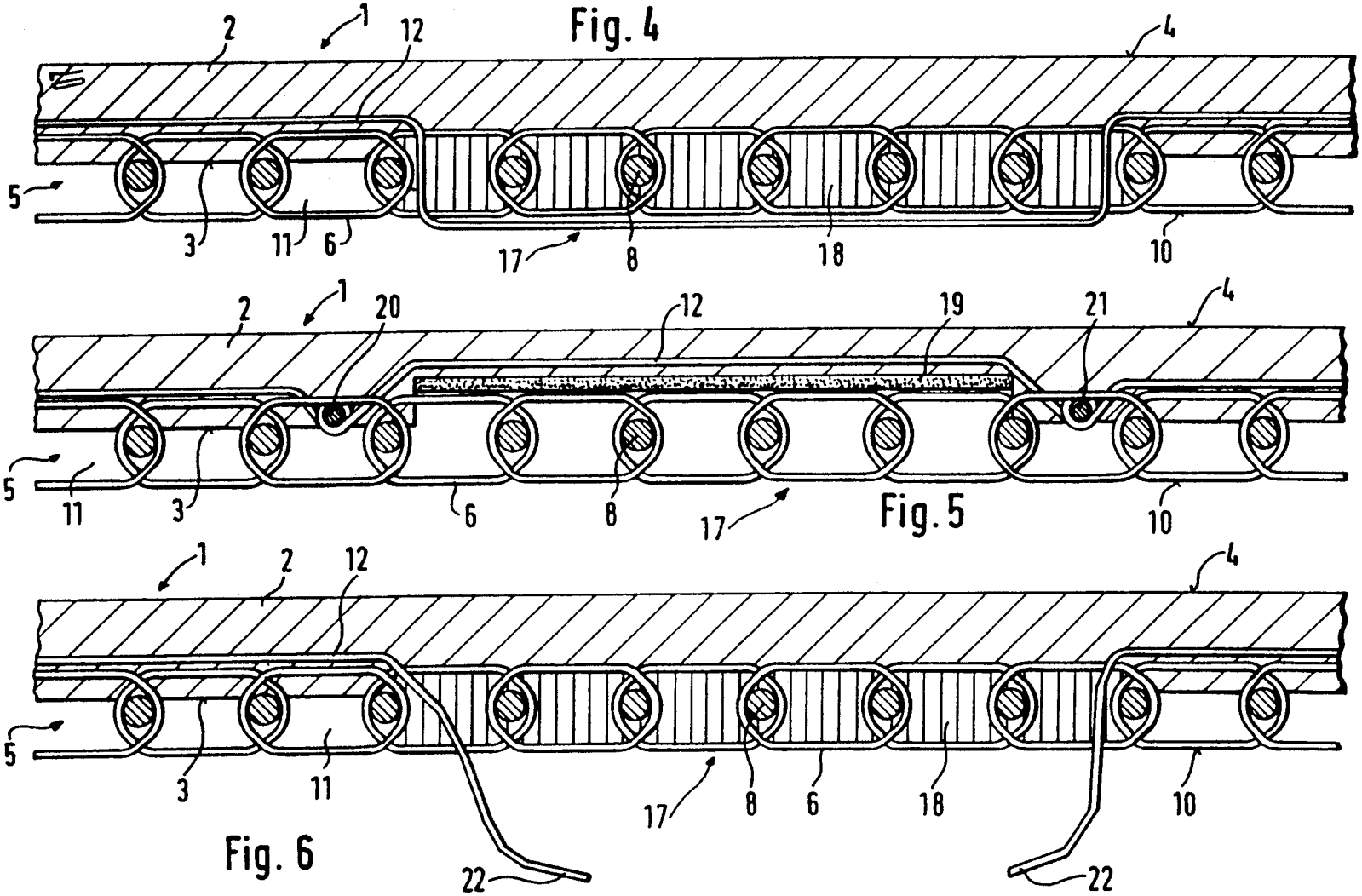
FIG. 4 is the cross-seam zone of the belt of FIG. 1 before the belt layer is separated.
FIG. 5 is the cross-seam zone of another belt before the separation of the belt layer.
FIG. 6 is the cross-seam zone of another belt before the separation of the belt layer.

In the embodiment of FIG. 4, the longitudinal threads 12 are made to pass from the belt layer 2 in the zone of the cross-seam 17 to the outside of the wire-link belt 5. First the longitudinal threads 12 consist of a single thread which, before the belt layer 2 is deposited, is placed around the wire-link belt 5 in coiled form along the direction of advance (arrow A) so that the longitudinal threads 12 each time form one turn of the single thread. The longitudinal threads 12 do not extend precisely in the direction of advance (arrow A) on account of the single thread being wound at some pitch.

In order to prevent the material of the belt-layer 2 from flowing into the wire spirals 6 in the cross-seam zone 17 during the coating procedure, these wire spirals 6, of which there is a total of six next to each other, are filled with polyvinyl alcohol before the belt layer 2 is deposited. After deposition of the belt layer 2 and its solidification, this filling 18 of polyvinyl alcohol is removed using water as a solvent. Then one of the coupling wires 8 of the wire spirals 6 is pulled out of the cross-seam zone 17. Thereupon the wire-link belt 5 shall be split at that site.

Thereupon the longitudinal threads 12 are severed in the area of the withdrawn coupling wire 8. Individual longitudinal threads 12 are created thereby of which the ends hang down in the cross-seam zone 17. At the same time those wire spirals 6 that do not enter the belt layer 2 can be pulled away downward. A region freed from the wire-link belt 5 has thus been created and space is made thereby for connecting the ends of the longitudinal threads 12. Then the belt layer 2 is severed too in that region in the transverse direction. The belt 1 now is of finite length, which is a convenient feature for its insertion into the wet press of a papermaking machine.

FIG. 5 shows another embodiment mode. The wire spirals 6 in the cross-seam zone 17 were covered with a band of adhesive 19 before the deposition of the belt layer 2, so that the material of the belt layer 2 cannot flow into those wire spirals 6, and hence the latter are free from any material. Again before the deposition of the belt layer 2, plug-in wires 20, 21 extending across the entire width of the belt 1 were inserted on both sides of the cross-seam zone 17 into the immediately adjacent wire spirals 6. In this case too the longitudinal threads 12 are formed by a single thread wound in coiled form on the wire-link belt 5. For each turn this single thread is wound several times around the plug-in wires 20, 21 and moreover it is made to pass between the plug-in wires 20, 21 and above the adhesive strip 19. Following deposition and solidification of the belt layer 2, there results the system shown in the Figure, where the plug-in wires 20, 21 are inside the belt layer 2. This design offers the additional advantage that the belt layer 2 is reinforced also in the cross-seam zone 17 by the longitudinal threads 12.

To make the belt 1 finite, one of the coupling wires 8 is the cross-seam zone 17 is pulled out. The adjacent wire spirals 6 then drop and release the adhesive strip 19. Said strip is removed. Next the belt layer is severed at a suitable site in the cross-seam zone (17).

To install the belt 1, all that is needed is to couple the meeting ends of the belt 1 by making the wire spirals 6 at the ends overlap and by reinserting the previously removed coupling wire 8. No special connection is then required for the ends of the longitudinal threads 12 because they are being joined in this embodiment mode by means of the wire spirals 6 in the cross-seam zone 17. The said spirals shall consist of the same material as the longitudinal threads 12 for this application, since they shall be required to absorb their tensions. The remaining gap in the belt layer 2 is then sealed by filling it with an adhesive.

The embodiment shown in FIG. 6 is a variation of that shown in FIG. 4. The sole difference is that in this case a single, coiled thread is not used for the longitudinal threads 12, but instead a number of finite longitudinal threads are arrayed one next to the other, with their ends following deposition on the wire-link belt 5 in the cross-seam zone 17 being made to pass through said belt. The wire spirals 6 are filled with polyvinyl alcohol 18 in the cross-seam zone 17. Following the deposition of the belt layer 2, the polyvinyl alcohol filling 18 will be rinsed out in the manner of the embodiment shown in FIG. 4. Thereupon one of the coupling wires 8 in the cross-seam zone 17 will be removed. Next the wire spirals 6 in the cross-seam zone 17 are pulled down so that an area of the belt layer 2 free of wire spirals 6 is formed. There the belt layer 2 can be milled to be made thinner to provide space to join the ends 22 of the longitudinal threads 22. Also, the belt layer 2 shall be severed there.

The belt 1 is inserted into the wet press as described in relation to the illustrative embodiment of FIG. 4.

The embodiment modes of FIGS. 7 and 8 show how the free ends of the longitudinal threads 12, present and produced by severing resp. in the embodiments of FIGS. 6 and 4, can be linked together in the papermaking machine. In both cases the ends 22 first are bent into loops illustratively denoted by 23.

In the embodiment of FIG. 7, the loops 23 are overlapping, and accordingly a plug-in wire 24 may be slipped through them. In this manner the longitudinal threads 12 can linked together in traction-proof manner. It shall be noted that for that purpose the belt layer 2 additionally has been milled away in the cross-seam zone 17 and is thin.

After the wire-link belt 5 and the longitudinal threads 12 have been coupled, that part of the cross-seam zone 17 which was or did remain free from the material of the belt layer 2 is filled with an adhesive 25 whereby the belt layer 2 evinces a constant cross-section also in the cross-seam zone 2. Moreover the gap 26 created in the severing procedure in the belt layer 2 is being filled. Thereupon the belt 1 is closed again and can be made operational in the wet press of the paper making machine.

As regards the embodiment shown in FIG. 8, the loops 23 are too short to overlap. Accordingly one plug-in wire 27, 28 each is inserted in two adjacent wire spirals 6 in such manner that each passes through the loops 23. As a result the longitudinal threads 12 in the cross-seam zone 17 are not linked together directly. However they are linked by the two adjacent wire spirals 6 crossed by the plug-in wires 27, 28. Therefore these two wire spirals 6 should also evince the tensile strength of the longitudinal threads 12 and hence be made of a traction-proof material such as polyester, an aramide or the like, whereas the remaining wire spirals 6 preferably shall consist of a highly wear-resistant material such as a polyamide.

Depending on need the longitudinal threads 12 and/or the addition threads 13 and/or the wire spirals 6 may be in the form of yarns, twists or monofilaments or multifilaments. Applicable materials are such polyesters as polybutyleneterephthalate or polyethyleneterephthalate or their copolymers, polyamides, polyetherketone, polyetheretherketone, polyphenylene sulfide, polypropylene, polyacrylonitride or also carbon or graphite.

Here again the cross-seam zone 17 is filled with an adhesive 25 so that the belt layer 2 shall be of the same cross-section in the cross-seam zone 17.

As regards the FIGS. 7 and 8, the cross-seam zone 17 is shown merely shortened relative to the representations of FIGS. 4 and 6, that is, it merely extends over four wire spirals 6. The length of the cross-seam zone 17 can be matched to requirements.

Further, the wire spirals 6 also may be designed in the manner described in the German Gebrauchsmustern 86 23 879.5 and 87 06 893.1.

We claim:

1. A belt for wet presses of papermaking machines, said belt comprising a flexible belt layer impermeable to liquids and smooth on its back side and with a support track such as a fabric, knit or a wire-link belt integrated at least in part on the front side of said belt layer which furthermore contains longitudinal threads extending in the direction of advance, characterized by the following features:

(a) The longitudinal threads essentially extend between the support track (5) and the back side (4) of the belt (1), and (b) The longitudinal threads (12) are linked in traction-proof manner at their ends (22) to absorb tensile forces.

2. Belt for wet presses of papermaking machines, said belt comprising a flexible belt layer impermable to liquids and smooth on its back side, where a support track with cavities has been integrated at least in part into the front side of said belt layer which contains longitudinal threads extending in the direction of advance, characterized by the following features:

(a) The longitudinal threads (12) essentially extend between the support track (5) and the back side (4) of the belt (1), and (b) The longitudinal threads (12) consist of at least one single thread extending both in the direction of advance and progressing transversely to the direction of advance.

3. Belt defined in claim 1, characterized in that the longitudinal threads (12) consist of a material of which the tensile strength is higher than that of the material of the parts of the support track (5) which are tensively loaded.

4. Belt defined in one of claim 1, characterized in that at least those parts forming the outer plane (10) of the support track (5) consist of a material which is more wear-proof than that of the longitudinal threads (12).

5. Belt defined in one of claim 1, characterized in that the longitudinal threads (12) pass in a plane parallel to the back side (4) of the belt (1).

6. Belt defined in one of claim 1, characterized in that the longitudinal threads (12) pass in several planes parallel to the back side (4) of the belt (1).

7. Belt defined in one of claim 1, characterized in that the longitudinal threads (12) are linked at regular intervals to the support tracks (5) and are laced into it.

8. Belt defined in one of claim 1, characterized in that at least one addition thread (13) is integrated into the belt layer (2) and extends in zig-zag manner progressively over the direction of advance of the belt (1).

9. Belt defined in claim 8, characterized in that said addition thread (13) thread segments (14) outside the support track (5) alternate with thread segments (15) laced into the support track (5).

10. Belt defined in claim 8, characterized in that said addition thread (13) assumes a coiled path with one reversal of direction (16) between every two thread segments (14, 15).

11. Belt defined in claim 8, characterized in that addition thread (13) passes between opposite side edges of the belt (1).

12. Belt defined in claim 11, characterized in that said addition thread (13) does not project beyond the lateral edge of the support track (5).

13. Belt defined in claim 9, characterized in that the support track consists of a wire-link belt (5) with wire spirals (6) transverse to the direction of advance of the belt (1) and in that said addition thread (13) passes each time by means of one thread segment (15) through one wire spiral and following reversal of direction (16) by means of the next thread segment (14) passes above the next wire spiral (6).

14. Belt defined claim 8, characterized in that the longitudinal threads (12) pass between the support track (5) and the thread segments (14) of said addition thread (13) outside the support track (5).

15. Belt defined in claim 8, characterized in that the longitudinal threads (12) are linked to said of the addition thread (13) at crossing points.

16. Belt defined in claim 1, characterized in that the longitudinal threads (12) are tied together by one of knots, fusing, and twisting.

17. Belt defined in claim 1, characterized in that the belt (1) comprises a cross-seam (17) at which the belt layer (2) can be interrupted and at which the support track (5) can be separated.

18. Belt defined in claim 17, characterized in that the ends (22) of the longitudinal threads (12) are detachably connected to each other in the vicinity of the cross-seam (17).

19. Belt defined in claim 18, characterized in that the ends (22) of the longitudinal threads (12) form overlapping loops (23) into which is inserted at least one plug-in wire (24, 27, 28).

20. Belt defined in claim 19, characterized in that the ends (22) of the longitudinal threads (12) are affixed in the vicinity o the cross-beam (17) to spaced plug-in wires (27, 28) transverse to the support track (5).

21. Belt defined in claim 17, characterized in that the ends of the longitudinal threads (12) are secured on both sides of the cross-seam (17) to the support track (5).

22. Belt defined in claim 21, characterized in that the longitudinal threads (12) are wound in coiled manner around the plug-in wires (20, 21) and then continue inside the belt layer (2) as far as its interruption.

23. Belt defined in claim 20, characterized in that in the area between the fastenings of the longitudinal threads (12) to the support track (5), the traction-loaded parts of the support track (5) consist of the same material as the longitudinal threads (12).

24. A method for making a belt defined claim 1 wherein a support track is prepared and is provided on one side with a belt-layer in such a manner that this support track still projects partly from the belt layer while being integrated into it only partly, characterized in that longitudinal threads (12) are peripherally deposited on that side of the support track (5) which shall be equipped with the belt layer (2) or in that at least one single thread shall be wound in coiled form before depositing the belt-layer (2).

25. Method defined in claim 24, characterized in that a support track (5) with an open seam is used, in that the longitudinal threads (12) in the seam zone (17) are made to pass out of the area provided for the belt layer (2) toward the side of the support track (5), in that the belt layer (2) is deposited with the seam of the support track (5) being closed, in that following solidification of the belt layer (2) the seam of the support track (5) is opened and the belt layer (2) is severed transversely.

26. Method defined in claim 25, characterized in that the support track (5) is protected in the zone of the cross-seam (17) against penetration by the material from the belt layer (2).

27. Method defined in claim 26, characterized in that the support track (5) is covered by a protective layer (19).

28. Method defined in claim 26, characterized in that the support track (5) is filled with a water-soluble substance (18).

29. Method defined in claim 25, characterized in that prior to the deposition of the belt layer (2), the longitudinal threads (12) are linked on both sides of the cross-seam zone (17) to the support track (5).

30. The belt of claim 2, wherein said longitudinal threads are comprised of a material having a tensile strength higher than the material of the parts of the support track which are tensively loaded.

31. The belt of claim 2, wherein at least those parts forming the outer plane of said support track are comprised of a material which is more wear-proof than that of the longitudinal threads.

32. The belt of claim 2, wherein:

the longitudinal threads pass in a plane parallel to the back side of said belt.

33. The belt of claim 2, wherein:

the longitudinal threads pass in several planes parallel to the back side of said belt.

34. The belt of claim 2, wherein:

the longitudinal threads are linked at regular intervals to said support track and/or are laced into it.

35. The belt of claim 2, wherein:

the longitudinal threads include at least one addition thread integrated into the belt layer and extending in a zig-zag manner progressively over the direction of advance of said belt.

36. The belt of claim 35, wherein:

said addition thread has thread segments outside said support track which alternate with thread segments laced into said support track.

37. The belt of claim 35, wherein:

said addition thread assumes a coiled path with one reversal of direction between every two thread segments.

38. The belt of claim 35, wherein:

said addition thread passes between opposite side edges of said belt.

39. The belt of claim 38, wherein:

said addition thread does not project beyond the lateral edge of said support track.

40. The belt of claim 36, wherein:

said support track comprises a wire-link belt having wire spirals extending transverse to the direction of advance of the belt, and in that said addition thread passes each time by means of one thread segment through one wire spiral and following reversal of direction by means of the next thread segment passes above the next wire spiral.

41. The belt of claim 35, wherein:

the longitudinal threads pass between said support track and said thread segments of at least one addition thread outside said support track.

42. The belt of claim 35, wherein:

the longitudinal threads are linked to at least one addition thread at crossing points.

43. The belt of claim 2, wherein:

the longitudinal threads are tied together by one of knots, fusing, and twisting.

44. The belt of claim 2, wherein:

said belt comprises a cross-seam at which the belt layer can be interrupted and at which said support track can be separated.

45. The belt of claim 44, wherein:

the ends of the longitudinal threads are detachably connected to each other in the vicinity of said cross-seam.

46. The belt of claim 45, wherein:

the ends of the longitudinal threads form overlapping loops into which are inserted at least one plug-in wire.

47. The belt of claim 46, wherein:

the ends of the longitudinal threads are affixed in the vicinity of said cross-seam to spaced plug-in wires transvere to the support track.

48. The belt of claim 44, wherein:

the ends of the longitudinal threads are secured on both sides of the cross-seam to the support track.

49. The belt of claim 48, wherein:

the longitudinal threads are wound in coiled manner around the plug-in wires and then continue inside the belt layer as far as its interruption.

50. The belt of claim 47, wherein:

the area between the fastenings of the longitudinal threads to said support track, and the traction-loaded parts of said support track, are comprised of the same material as the longitudinal threads.

* * * * *